313-422 SR
5/29/84 OR 4,451,756

United States Patent [19]
Sato et al.

[11] 4,451,756
[45] May 29, 1984

[54] FLAT CATHODE RAY TUBE

[75] Inventors: Hiroki Sato, Chiba; Takao Nakano, Yokohama; Masato Hatanaka, Koshigaya; Toshio Ohhoshi, Yokohama; Sakae Tanaka, Tokyo, all of Japan

[73] Assignee: Sony Corporation, Tokyo, Japan

[21] Appl. No.: 323,455

[22] Filed: Nov. 20, 1981

[30] Foreign Application Priority Data

Nov. 25, 1980 [JP] Japan ..... 55-165568

[51] Int. Cl.[3] ..... H01J 29/70
[52] U.S. Cl. ..... 313/422; 313/431; 313/433
[58] Field of Search ..... 313/422, 439, 437, 442, 313/431, 432, 433

[56] References Cited

U.S. PATENT DOCUMENTS

| | | | |
|---|---|---|---|
| 2,795,729 | 6/1957 | Gabor | 313/422 X |
| 3,435,269 | 3/1969 | Shanafelt et al. | 313/422 |
| 3,683,224 | 8/1972 | Lea | 313/422 |
| 3,890,541 | 6/1975 | McCarthy et al. | 313/422 X |
| 4,339,694 | 7/1982 | Ohkoshi et al. | 313/422 X |

FOREIGN PATENT DOCUMENTS

| | | | |
|---|---|---|---|
| 56-116256 | 9/1981 | Japan | 313/422 |

*Primary Examiner*—David K. Moore
*Assistant Examiner*—K. Wieder
*Attorney, Agent, or Firm*—Hill, Van Santen, Steadman & Simpson

[57] ABSTRACT

A cathode ray tube which comprises: an evacuated envelope having at least one transparent flat portion, a fluorescent target arranged on the inner surface of the flat portion, an electron gun within the envelope in laterally spaced relation to the target for emitting an electron beam along a path parallel with the surface of the flat portion, a first deflecting device comprising the target, and an opposite electrode in the envelope for impinging the electron beam upon the target, a second deflecting device comprising a pair of plates to control the electron beam passing therebetween and arranged in the envelope for deflecting the electron beam perpendicularly to the surface of the flat portion, the pair of plates being connected with the opposite electrode and the anode electrode of the electron gun, respectively, and a vertical deflection signal being applied to the anode electrode, and a third deflecting device arranged adjacent to the envelope in cooperation with the pair of plates for concentrating deflecting flux generated by means of the third device on the electron beam between the pair of plates for deflecting the electron beam in parallel with the surface of the flat portion and generally transverse to the direction of the electron beam, thereby to produce an image on the target.

25 Claims, 13 Drawing Figures

FLAT CATHODE RAY TUBE

BACKGROUND OF THE INVENTION

1. Field of the Invention

This invention relates to a flat-type cathode ray tube and more particularly to a flat-type cathode ray tube in which an electron gun is extendably mounted along a surface direction of a fluorescent screen thereby to improve the flatness of the tube envelope.

2. Description of the Prior Art

The prior art includes a flat-type cathode ray tube as shown in FIGS. 1 and 2, having a fluorescent screen 2 disposed on one inner surface of a flat envelope 1, a back electrode 3 mounted thereon so as to oppose the fluorescent screen 2 and an electron gun 4 mounted along a surface direction of the fluorescent screen 2. The gun 4 is positioned in such a manner that the axis thereof lies, with the tube axis, in a central vertical direction of the fluorescent screen 2. Reference numeral 5 represents a transparent target electrode onto which the fluorescent screen 2 is coated. To this target electrode 5, that is, the fluorescent screen 2 is applied an anode voltage $V_H$ of a high voltage, for example 5 KV and to the back electrode 3 is applied a high voltage $V_B$, for example, 4 KV a little lower than the preceding anode voltage $V_H$, to form thereby a first deflecting system between the fluorescent screen 2 and the back electrode 3. A second deflecting system is provided in the area between the electron gun 4 and the fluorescent screen 2 and by action of the first and second deflecting systems, the electron beam b is horizontally and vertically deflected to scan the fluorescent screen 2. Accordingly, the second deflecting system horizontally and vertically deflects the electron beam b emitted from the electron gun 4. Here the horizontal deflection designates a deflection of the electron beam b along a direction of the arrow H which perpendicularly intersects an axial direction of the fluorescent screen 2, to thereby horizontally scan the fluorescent screen 2, (a so-called horizontal scanning). The vertical deflection represents a deflection of the beam b in a direction which perpendicularly intersects the fluorescent screen 2 to thereby move the beam b on the fluorescent screen 2 in a direction perpendicular to the aforedescribed scanning direction, (a so-called vertical scanning). Numeral 6 denotes a horizontal and vertical deflecting means and this deflecting means 6 uses an electromagnetic deflection to perform, for example, the horizontal deflection which requires a relatively large deflecting angle, and uses an electrostatic deflection which employs, for example, the pair of inner pole pieces utilized for the aforesaid electromagnetic horizontal deflection as electrostatic deflecting plates to perform the vertical deflections.

As shown in the figure, this deflection means 6 is comprised of: (1) a magnetic core 7 of an annular shape formed of, for example, a ferrite having a high magnetic permeability and which is provided at the rear side of the electron gun 4 so as to surround an external surface of the envelope 1, (2) an electromagnetic coil 8 (8*a* and 8*b*) to carry a horizontal deflecting current therethrough and (3) a pair of inner pole pieces or electrostatic deflecting plates 9*a* and 9*b* comprising a high magnetic permeability material placed within the envelope 1. The magnetic core 7, a cross-section of which is shown in FIG. 2, is formed of an annular shape so as to surround the external surface of the envelope 1. Inwardly projected outer center poles 7*a* and 7*b* are opposed to each other in a widthwise direction of the envelope 1. The coils 8*a* and 8*b* are wound on the external surfaces of these outer center poles 7*a* and 7*b* or the coil may be wound to any one of the external surface thereof. By such an arrangement, a magnetic flux generated in accordance with the horizontal deflecting current flowing in the coil 8 (8*a* and 8*b*) is provided between both outer center poles 7*a* and 7*b* and hence a magnetic field is applied to the widthwise direction of the envelope 1 across the passage of the electron beam b between the inner pole pieces 9*a* and 9*b* intermediate therebetween. The inner pole pieces or electrostatic deflecting plates 9*a* and 9*b* within the envelope 1 are formed of plate-shaped high magnetic permeability material of substantially trapezoidal shape placed across the passage of the electron beam b so as to oppose each other on both sides with respect to the widthwise direction of the envelope 1 such that the space therebetween is widened in the direction toward the screen 2 and likewise such deflecting plates 9*a* and 9*b* may become widened towards the screen. Further, the pair of pole pieces or electrostatic deflecting plates 9*a* and 9*b* may be comprised of, for example, a high magnetic permeability material having a resistivity in which a surface electric resistance is $10^7$ ω cm or below, more preferably $10^4$ ω cm or below, such as the ferrites, and these are used to deflect the above-described electron beam b vertically. That is, a vertical deflecting voltage is applied between both inner pole pieces or electrostatic deflecting plates 9*a* and 9*b*. In this case, a back electrode voltage of, for example, 4 KV, is applied to the inner pole pieces or electrostatic deflecting plates of the deflecting means 6, and the vertical deflecting signal voltage is further superimposed therebetween.

In the flat-type cathode ray tube of such prior art construction, as described above, the electron beam b emitted from the electron gun 4 under the influence of the first and second deflection systems, is adapted to scan horizontally and vertically the fluorescent screen 2.

According to the cathode ray tube thus arranged, the whole of the cathode ray tube can be flattened. However, since the electron gun 4 is disposed along and generally parallel to the surface direction of the fluorescent screen 2, as shown, and on account of the fact that the upper and lower portion of the screen are different distances from the lens system of the electron gun 4, i.e., by the vertical scanning distance, the flying distance of the electron beam to the upper and lower portions of the screen is different. It becomes necessary, accordingly, to adjust the focusing, that is, to perform what is called a dynamic focusing correction in accordance with a scanning position of the electron beam b in order to satisfactorily focus the beam spot at each position.

The dynamic focusing correction is normally carried out by applying a correction signal voltage to a focusing electrode of the electron gun. For example, as shown in FIG. 3, in an arrangement wherein the electron gun 4 is composed of a cathode K, a first grid $G_1$, a second grid $G_2$, a third grid $G_3$, and a fourth grid $G_4$ comprise a main electron lens of a bi-potential type, the dynamic focusing correction voltage is adapted to be supplied to the third grid $G_3$ of the focusing electrode thereof. At that time, when 5 KV of the anode voltage $V_H$ or a fixed voltage of 4 KV of the back electrode voltage $V_B$ is applied, for example, to the fourth grid $G_4$ and a fixed voltage of 500 V is applied to this third grid $G_3$, it is arranged that the dynamic focusing correction voltage of about 30 V is superimposed on the aforesaid fixed voltage of 500 V, which is supplied to the third grid $G_3$ during a vertical scanning period.

OBJECTS AND SUMMARY OF THE INVENTION

An object of this invention is to provide a flat-type cathode ray tube in which an electron gun is extendably mounted along a surface direction of a fluorescent screen thereby to improve the flatness of an envelope.

Another object of this invention is to provide a flat-type cathode ray tube in which, a dynamic focusing (correction) is automatically performed together with the vertical deflection so that the arrangement thereof can be made simple.

A further object of this invention is to provide a flat-type cathode ray tube of a post-acceleration arrangement in which a vertical deflection and the dynamic focusing (corrrection) during like vertical period are performed by the same signal.

According to an aspect of the present invention there is provided a cathode ray tube which comprises: an evacuated envelope having at least one transparent flat portion, a fluorescent target arranged on the inner surface of the flat portion, an electron gun within the envelope in laterally spaced relation to the target for emitting an electron beam along a path parallel with the surface of the flat portion, first deflecting means comprising the target and an opposite electrode in the envelope for impinging the electron beam upon the target, second deflecting means comprising a pair of plates to put the electron beam therebetween arranged in the envelope for deflecting the electron beam perpendicularly to the surface of the flat portion, the pair of plates being connected with the opposite electrode and anode electrode of the electron gun, respectively, and a vertical deflection signal being applied to the anode electrode, third deflecting means arranged adjacent to the envelope in cooperation with the pair of plates for concentrating deflecting flux generated by means of the third means on the electron beam between the pair of plates and for deflecting the electron beam in parallel with the surface of the flat portion, thereby to produce an image on the target.

The other objects, features and advantages of the present invention will become apparent from the following description taken in conjunction with the accompanying drawings throughout which the like references designate the same elements and parts.

DESCRIPTION OF THE PREFERRED EMBODIMENT

Considering a case wherein the fixed voltage is applied to the third grid and the dynamic focusing (correction) is carried out at the fourth grid which is a final arrangement of the electron gun, the inventors of this invention have established the fact that the dynamic focusing (correction) voltage to be supplied to the fourth grid was approximated to the vertical deflection voltage of this flat-type cathode ray type of post acceleration type.

Figure 1:
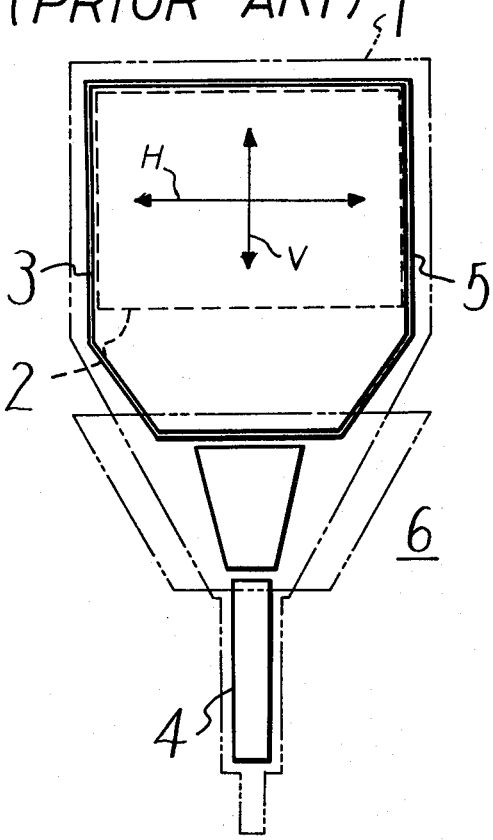
FIG. 1 (PRIOR ART)
FIGS. 1 and 2 are a front view and a side view of a prior art flat-type cathode ray tube each useful for explaining this invention.
Figure 2:
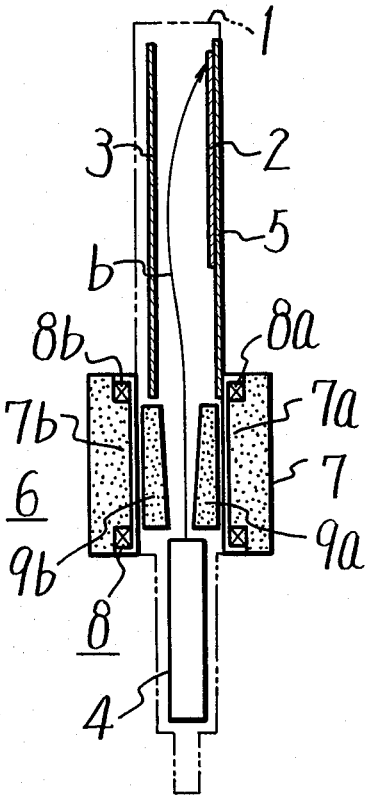
FIG. 2 (PRIOR ART)
Figure 3:
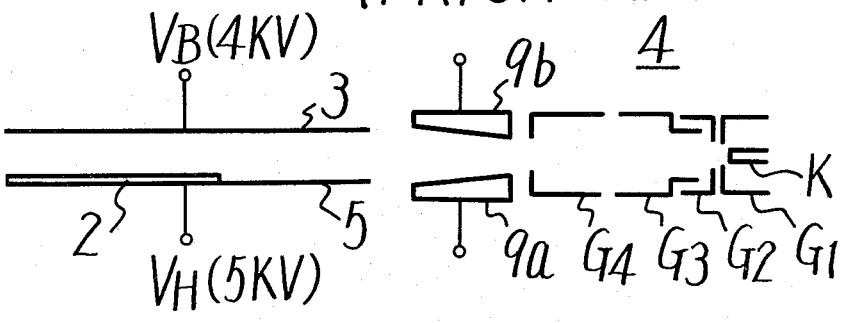
FIG. 3 (PRIOR ART)
FIG. 3 is an explanatory view thereof.
Figure 4:
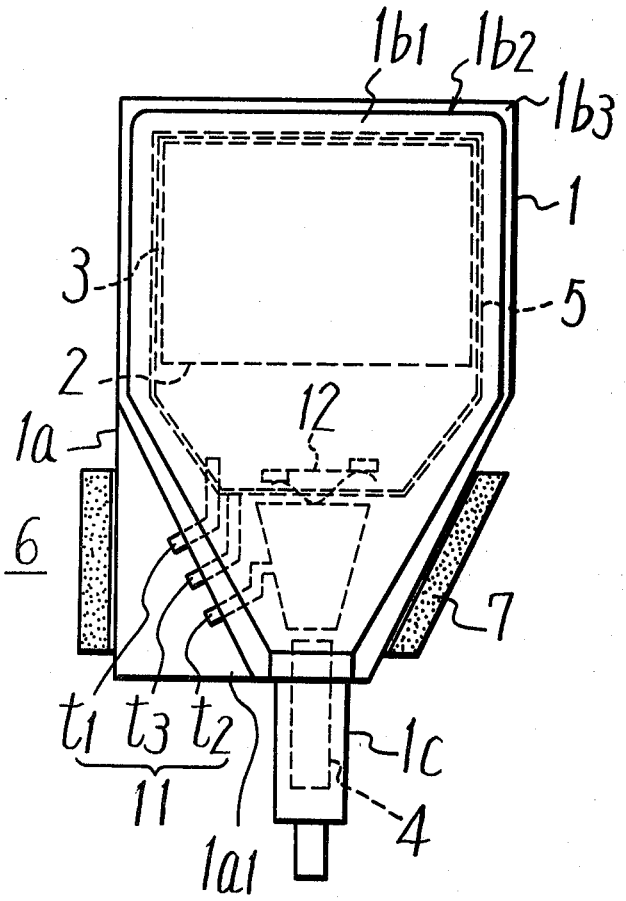
FIGS. 4 and 5 are a front view and a side view each taking one part as a cross-section of one example of a flat-type cathode ray tube according to this invention.
Figure 5:
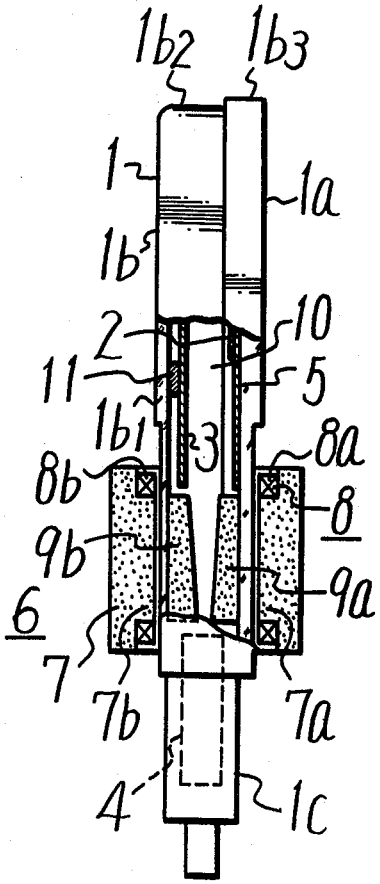
Figure 6:
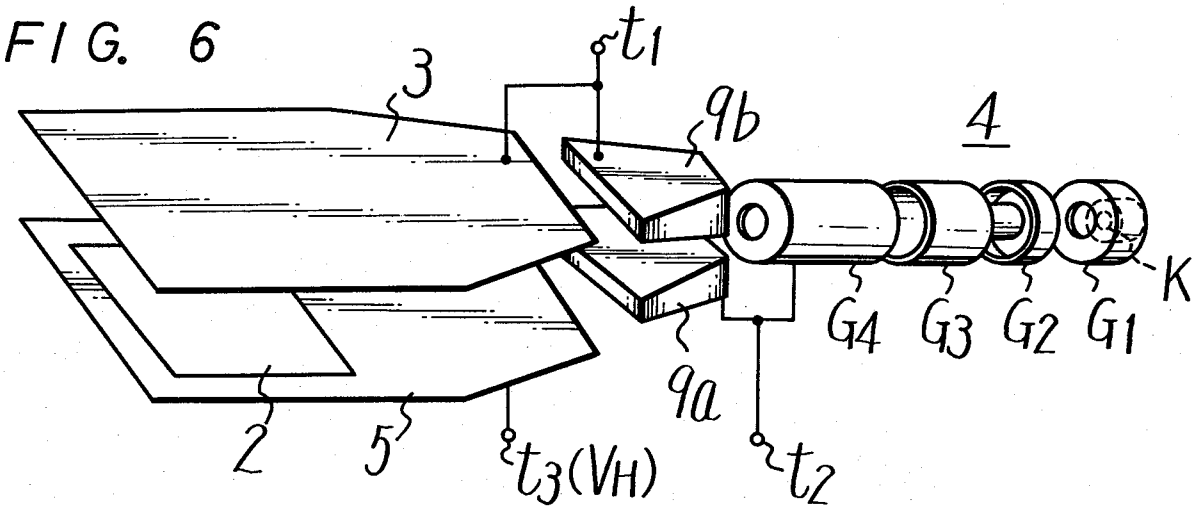
FIG. 6 is a perspective view of an arrangement of an electrode shown in FIGS. 4 and 5.

This invention will now be described with reference to FIGS. 4–13. In these figures, parts corresponding to those in FIGS. 1 to 3 are marked with the same reference numerals and the explanations thereof are made briefly. In this case, this flat envelope 1 is comprised of a panel such as a glass substrate 1*a*, a glass funnel 1*b* connected to one surface thereof to form a flat space 10 between the panel 1*a* and the glass funnel 1*b*, and a glass necked tube 1*c* connected to one side of these so as to extend along a surface direction of the flat space 10 and to continuously connect into the flat space 10.

The funnel 1*b* includes a flat plate portion $\mathbf{1}b_1$ opposing to the panel 1*a*, a peripheral side wall portion $\mathbf{1}b_2$ extended toward the panel 1*a* on the periphery thereof and a flange portion $\mathbf{1}b_3$ air-tightly connected with the panel 1*a* by a frit bonding.

On the other hand, the panel 1*a* is formed with an outline shape corresponding to the peripheral shape of the funnel 1*b* and having an elongated plate portion $\mathbf{1}a_1$ projecting to a left or right side. By providing the long distance along the surface of this elongated plate portion $\mathbf{1}a_1$, it is intended to improve arc discharge preventing (in view of safety standards) between the high voltage terminal group 11 and other parts, such as the cabinet that this flat-type cathode ray tube is assembled into, for example.

On an inner surface of the funnel 1*b*, that is, an inner surface of the peripheral side wall portion $\mathbf{1}b_2$ is bonded or coated a conductive layer (not shown) such as a carbon layer to which the anode voltage $V_H$ is supplied.

On the inner surface of the panel 1*a* is bonded or deposited a transparent conductive layer composing the target electrode 5. After the fluorescent screen 2 is coated thereon a metal back is applied thereto forming the completed target electrode 5. Further, it may be desired to coat a carbon layer in a picture-frame-shaped pattern having a window in a part corrresponding to an effective picture area of the fluorescent screen 2 to thereby form the target electrode 5 and within the window thereof is coated the fluorescent screen 2 across the picture-frame-shaped portion.

Also, a further arrangement may be used. The back electrode 3 placed opposite the target electrode may be made of a metal plate bonded by the frit to be secured utilizing studs 11 at a predetermined position of the flat plate portion $\mathbf{1}b_1$ of the funnel 1*b* so as to form the back electrode 5.

The horizontal and vertical deflecting means 6 is comprised of the magnetic core 7 of an annular shape formed of, for example, a ferrite having high magnetic permeability and surrounding the external periphery of the envelope 2 as previously described; the electro-magnetic coil 8 (8*a* and 8*b*) conducting the horizontal deflecting current and a high magnetic permeability magnetic material placed within the envelope 1 opposingly to the widthwise direction of the flat envelope 1. The horizontal and vertical deflecting means 6 is further composed of the inner pole pieces or electrostatic deflecting plates (hereinafter simply referred to as the electrostatic deflecting plates) 9*a* and 9*b* having a predetermined electric conductivity in which the surface resistance of the opposite internal surface thereof is about $10^7$ Ω cm or below and more preferably $10^4$ Ω cm or below. Especially in this invention, the electrostatic deflecting plate on the side corresponding to the side wherein the back electrode 3 is mounted, i.e., the electrostatic deflecting plate 9*b* as shown by the example in the figure, is electrically coupled to the back electrode 3 to thereby lead to terminal $t_1$. The other electrostatic deflecting plate 9*a* is electrically coupled to an anode of a final portion of the electron gun 4, i.e., the fourth grid $G_4$ as shown for example in FIG. 6 via a terminal $t_2$ and a terminal $t_3$ is led out from the target electrode 5.

To the terminal $t_1$, that is, the back electrode 3 and the electrostatic deflecting plate 9*b*, is applied the back electrode voltage $V_B$, for example, a fixed voltage of 4 KV, to form the first deflecting system. To the terminal $t_3$, that is the target electrode, is applied the high voltage $V_h$ such as the fixed voltage of 5 KV. To the terminal $t_2$, i.e., the other electrostatic deflecting plate 9*a*, is applied a vertical deflecting signal voltage $V_{def}$ taking the back electrode voltage $V_b$ as substantially a main or central voltage. In other words, to the terminal $t_2$ is supplied a deflecting signal voltage of a saw-tooth wave which changes approximately from $V_B-\frac{1}{2}V_{def}$ to $V_B+\frac{1}{2}V_{def}$ during the vertical scanning period. For example, if the back electrode voltage $V_B$ is given as 4 KV and the vertical deflecting signal voltage $V_{def}$ as 250 V, to the terminal $t_2$ is applied the deflecting signal voltage of, for example, 3.875 KV to 4.125 KV. At that time, to the third grid $G_3$ is supplied the fixed voltage of 500 V, to the second grid $G_2$ the fixed voltage of 250 V, to the first grid $G_1$ a ground electric potential and to the cathode K a video signal voltage of 0 to 30 V.

Supplying the deflecting voltage to the terminal $t_2$ is accomplished by a capacity coupling or an inductance coupling. In this case, these three terminals $t_1$, $t_3$, $t_2$ are placed in parallel with one another in order shown in FIG. 4. When these terminals are placed in parallel with one another in the order of the value of voltage applied thereto, the spaces between terminals are reduced in comparison with the case illustrated in FIG. 4 in view of arc discharge between terminals. Accordingly, these terminals are preferably placed in order of $t_3$, $t_1$, and $t_2$.

Figure 7:
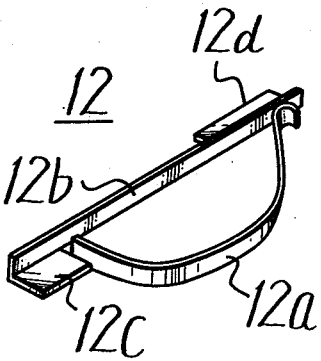
FIG. 7 is a perspective view of one example of a spring shown in FIG. 4.

In order to electrically connect the back electrode 3 with the electrostatic deflecting plate 9*b* provided on the side corresponding thereto, as shown in FIG. 7, for example, a spring 12 formed of a thin metal plate which is punched out and bent is welded on the external surface of the back electrode plate 3 and a free end thereof is resiliently contacted with an end surface in the rear side of the electrostatic deflecting plate 9*b*. The spring 12 contains two band-shaped members 12*a* and 12*b* which are connected to each other at each end thereof. The coupling member 12*c* and bent piece 12*d*, provided on the free end of one band-shaped member 12*b*, are welded onto the back of the back electrode plate 3.

Figure 9:
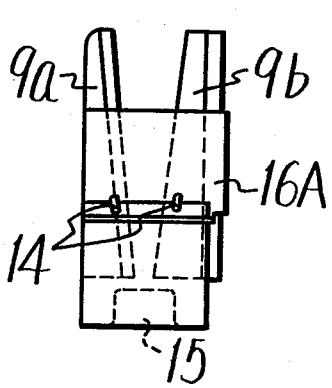
FIGS. 8, 9 and 10 are respectively a top view, a side view and a rear view of an electrostatic deflecting plate arrangement used in the example of FIGS. 4 and 5.
Figure 8:
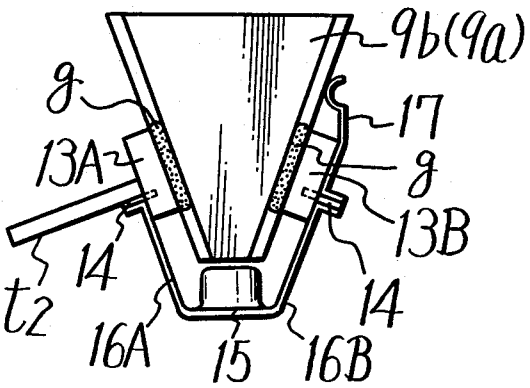
Figure 10:
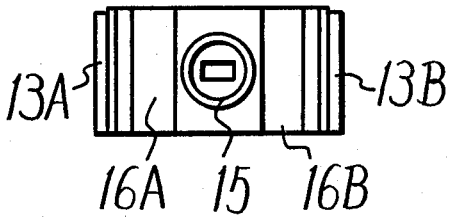

Both electrostatic deflecting plates 9*a* and 9*b* are mechanically coupled to each other, as shown in FIGS. 8 to 10, so that both deflecting plates 9*a* and 9*b* face each other keeping a predetermined positional relation therebetween and a pair of insulating plates 13A and 13B of material such as ceramic are provided on left and right side surfaces of both deflecting plates 9*a* and 9*b* across both of them and are fused and bonded thereto by glass g. At the outside of both insulating plates 13A and 13B are fixedly embedded a pair of two pins, or pins comprised of one pin on one side and two conductive pins 14 on another side, which are coupled to a metal cylindrical guide body 15 smoothly accepting the electron gun 4 into the space between deflecting plates 9*a* and 9*b*. On the cylindrical body 15 are provided arm pieces 16A and 16B elongated left and right therefrom with the free ends thereof welded to the pins 14 of the left and right insulating plates 13A and 13B so that both deflecting plates 9*a* and 9*b* are mechanically connected to the cylindrical body 15 concentrically. Within this cylindrical guide body 15 is inserted the end portion of the electron gun 4, such as the fourth grid $G_4$, for example, having a cylindrical shape so that the guide 15 and the grid $G_4$ are electrically coupled to each other and in addition, the electron gun 4 and the deflecting plates 9*a* and 9*b* are concentrically oriented on the axis. On the other hand, for example, on the right side pin 14 is welded one end of a conductive metal contact piece 17 and a free end thereof is contacted with a side surface of one deflecting plate 9*a* thereby to electrically connect the fourth grid $G_4$ with the deflecting plate 9*a*.

Figure 11:
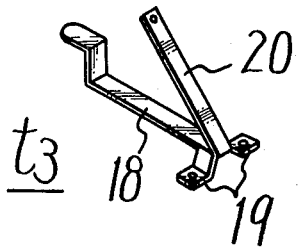
FIGS. 11 and 12 are respectively a perspective view and an arrangement view of one example of a high voltage terminal piece used in the example of FIGS. 4 and 5.
Figure 12:
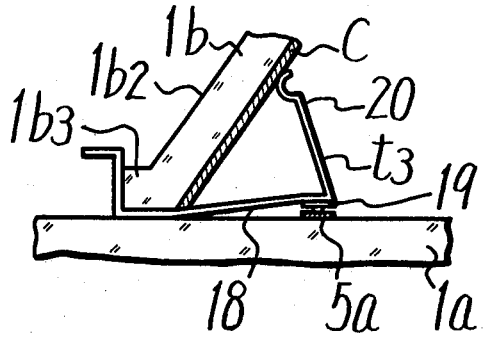

Each of the high voltage terminals $t_1$ to $t_3$ can be formed of metal pieces and the terminals $t_1$ to $t_3$ are placed in parallel and to each outer end are connected lead wires to connect an external circuit therewith. Or, it may be also provided that the terminal group is embedded into the glass funnel 1*b*. The inner end of the metal piece terminal $t_1$ is welded, for example, to the external side surface of the back electrode 3, and that of the metal piece terminal $t_2$ is welded to the pin 14 electrically coupled to the cylindrical guide body 15 which is connected to the electrostatic deflecting plate 9*a* and the grid $G_4$. Further, the metal piece $t_3$ is provided with an elastic foot member 19 on both sides of a band-shaped resilient piece member 18 as shown in FIG. 11. As illustrated in FIG. 12, these foot members 19 are resiliently contacted with the conductive layer 5*a* such as the carbon layer elongated from the target electrode 5 and a tongue piece 20 bent up from the inner end of the resilient piece member 18 is contacted with an inner surface conductive layer c coated on the peripheral side wall portion 1*b*$_2$ of the funnel portion 1*b* thereby supplying the anode voltage $V_H$.

According to an arrangement of this invention as set forth above, since the vertical deflecting voltage is applied between a pair of the electrostatic deflecting plates 9*a* and 9*b* composing the second deflecting system, the electron beam is vertically scanned on the fluorescent screen 2 by the electrostatic field generated therefrom. In this case, since this vertical deflecting voltage is also supplied to the fourth grid $G_4$, the strength of the focusing action of the main electron lens of the bi-potential type formed by the fourth grid $G_4$ and the third grid $G_3$ to which the fixed voltage is applied is altered. Between both electrostatic deflecting plates 9*a* and 9*b* is supplied a maximum voltage taking the deflecting plate 9*b* side as positive so that when the electron beam exists in the farthest vertical scanning position on the fluorescent screen 2 from the electron gun 4, a voltage difference between the fourth and third grids $G_4$, and $G_3$ is made smallest and the focusing action of the main electron lens is weakened, thereby making the focus position farthest. On the contrary, when a maximum voltage, taking the deflecting plate 9a side as positive, is supplied therebetween so that the electron beam exists, on the fluorescent screen 2 in the nearest vertical scanning position from the electron gun 4, the voltage difference between the fourth and third grid $G_4$ and $G_3$ is made largest and the focusing action of the main electron lens is strengthened, thereby making the focus position nearest. As a result, a focus adjustment is carried out in synchronism with the vertical deflection so as to form a good beam spot on each vertical scanning position.

Figure 13:
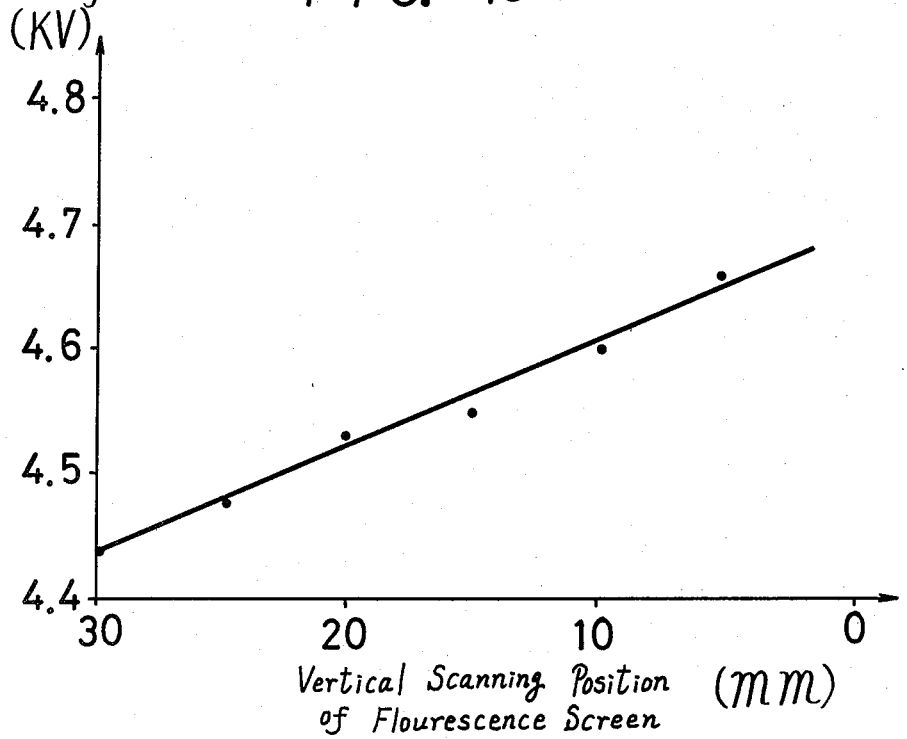
FIG. 13 is a graphic representation of a measurement curve showing a relation between a deflecting voltage and a vertical scanning position of the invention.

FIG. 13 illustrates the relation between the vertical scanning position on the fluorescent screen 2 and the vertical deflecting voltage $V_{def}$ and it is apparent that a satisfactory linearity is obtained. At that case, the anode voltage $V_H$ is selected as 5.5 KV, the back electrode voltage $V_B$ as 4.55 KV and a maximum deflection voltage to be applied between the deflecting plates 9a and 9b as 0.95 KV. In this case, the vertical deflecting signal voltage $V_{def}$ and the vertical scanning position show a good linearity. However, should they not show proper linearity, if the waveform of the signal voltage $V_{def}$ is changed to an appropriate one in accordance with the above, vertical scanning having a good linearity can be realized.

In accordance with the arrangement of this invention as described above, since the dynamic focusing (correction) is carried out together with the vertical deflection, it is not necessary to supply a particular focusing correction signal to, for example, the third grid $G_3$ and the arrangement thereof can be simplified. However, if a distance from a deflecting center of the second deflecting system of the electron beam, to a central portion with respect to the horizontal scanning direction on the fluorescent screen 2, is different from that of up to the peripheral portion, the dynamic focusing (correction) voltage with respect to the horizontal scanning direction is applied to the focusing electrode, for example, the third grid $G_3$ of the electron gun 4 so as to correct the difference thereof.

In the aforedescribed embodiment of the invention, the vertical deflecting voltage is applied to the terminal $t_2$, that is, any one of a pair of the electrostatic deflecting plates 9a and 9b and in other cases, such vertical deflecting voltage can be applied to both deflecting plates 9a and 9b, i.e., the terminals $t_1$ and $t_2$. For example, if the $V_H$ is selected as 5 KV, the $V_B$ as 4 KV and the $V_{def}$ as 250 V, to the terminals $t_1$ and $t_2$ are applied the signal voltages of $V_B$ to $(V_B-\frac{1}{2}V_{def})$ and $(V_B-\frac{1}{2}V_{def})$ to $V_B$ each having contrary waveforms during the vertical period.

As seen in the above, according to this invention, it becomes possible to perform the vertical scanning accompanied by the focusing correction and in addition, although the electrode to which the high voltages are applied requires four electrodes of the target electrode 5, the back electrode 3 and the electrostatic deflecting plates 9a and 9b, since the number of the terminals to be led out therefrom is reduced to three high voltage terminal $t_1$ to $t_3$ by the arrangement of this invention, it also becomes quite easy to lead out the high voltage terminals free from a problem of arc discharge.

Further, according to the aforedescribed arrangement of this invention, since the first deflecting system becomes the high voltage side to form an post-focusing type system and the second deflecting system to perform a main horizontal and vertical scanning forms a low-speed portion of the beam, the deflecting sensitivity can be raised and in this connection, there is an advantage that the deflecting voltage can be made smaller.

As seen in the above, if the inner pole pieces or electrostatic deflecting plates 9a and 9b perform the vertical horizontal deflections as the second deflecting system at the same position, there is further advantage that an availability of a space in the envelope can be raised, the deflecting centers of these are made nearer to the fluorescent screen side and the length of the envelope in the vertical scanning direction on the screen can be shortened if the deflecting angles thereof are made larger than the angle of narrow portion of panel.

Further, in the flat-type cathode ray tube according to this invention, with respect to the positional relation of the back electrode and the fluorescent screen, a modification becomes possible in which the back electrode may become the panel side and the fluorescent screen the funnel side, or the back electrode is taken as the transparent electrode and the screen may be observed from this transparent back electrode side. If so arranged, it is apparent that the aforedescribed modification will not depart from the patentable concepts of this invention.

We claim as our invention:

1. A cathode ray tube, comprising:

an evacuated envelope having at least one transparent flat portion;

a fluorescent target arranged on the inner surface of said flat portion;

an electron gun within said envelope in laterally spaced relation to said fluorescent target for emitting an electron beam along a path parallel with the surface of said flat portion;

first deflecting means comprising said fluorescent target and a back electrode in said envelope for impinging said electron beam upon said fluorescent target;

second deflecting means for deflecting said electron beam vertically comprising a pair of plates arranged in said envelope to pass said electron beam therebetween, one of said pair of plates connected to said back electrode, and a vertical deflection signal applied to the other one of said pair of plates for deflecting said electron beam vertically on said fluorescent target and for dynamic focusing said electron beam;

third deflecting means for deflecting said electron beam laterally comprising external means arranged adjacent to said envelope for generating magnetic flux and concentrating said magnetic flux on said electron beam between said pair of plates, and deflecting said electron beam laterally on the said surface of said fluorescent target, thereby to produce an image on said fluorescent target.

2. A cathode ray tube according to claim 1, in which said vertical deflection signal is applied to said anode electrode of said electron gun and said other one of said pair of plates connected to said anode electrode.

3. A cathode ray tube according to claim 2, in which said one of said pair of plates is adjacent to said back electrode and said other plate is adjacent to said fluorescent target and is electrically connected to said anode electrode of said electron gun.

4. A cathode ray tube according to claim 1, in which said back electrode is transparent.

5. A cathode ray tube according to claim 1, in which said external means comprises a ring-shaped magnetic core surrounding said envelope and coil means located adjacent to said core for generating magnetic flux perpendicular to the direction of said electron beam emitted from said electron gun.

6. A cathode ray tube according to claim 1, in which said third deflecting means is formed of high magnetic permeable material with internal surfaces having resistivity lower than $10^7$ Ω cm.

7. A cathode ray tube according to claim 5, in which said ring-shaped magnetic core has at least one protruding portion with said coil means wound therearound.

8. A cathode ray tube according to claim 1, in which said second deflecting means and said third deflecting means in cooperation with said first deflecting means provide vertical scanning and horizontal scanning of said electron beam on said fluorescent target, respectively.

9. A cathode ray tube according to claim 1, in which said pair of plates are arranged in respective opposing positions.

10. A cathode ray tube according to claim 1, in which each planar view of said pair of plates is substantially trapezoidal shape such that their width thereof increase in the direction of said electron beam.

11. A cathode ray tube according to claim 7, in which respective plane figures of said pair of plates are substantially trapezoidal in shape such that the width thereof increases in the direction of said electron beam.

12. A cathode ray tube according to claim 10, in which said planar view of each of said pair of plates is the same.

13. A cathode ray tube according to claim 11, in which said planar view of said protruding portion is similar to the planar view of said pair of plates and said protruding portion is larger than the pair of plates.

14. A cathode ray tube according to claim 1, in which the opposite surfaces of said pair of plates diverge outwardly from each other in the direction which said electron beam travels.

15. A cathode ray tube according to claim 1, in which said first deflecting means comprising said fluorescent target and said back electrode forms an electrostatic field therebetween.

16. A cathode ray tube according to claim 15, in which the fixed voltage applied to said fluorescent target is higher than that applied to said back electrode.

17. A cathode ray tube according to claim 3, in which said vertical deflection signal is applied to said one plate and the fixed voltage lower than that applied to said fluorescent target is applied to said other one of said plates for providing horizontal scanning of said electron beam on said fluorescent target.

18. A cathode ray tube according to claim 3, in which electrical connecting means is fixed to said back electrode and a free end thereof makes resilient contact with said one plate.

19. A cathode ray tube according to claim 18, in which said mechanical connecting means aligns the axis of said electron gun.

20. A cathode ray tube according to claim 19, in which said mechanical connecting means is fixed to insulating means.

21. A cathode ray tube according to claim 20, in which said mechanical connecting means comprises a guide bracket for supporting said electron gun and a pair of arm pieces fixed to said insulating means.

22. A cathode ray tube according to claim 1, in which a first terminal for supplying said fluorescent target with anode voltage, a second terminal for supplying said back electrode with the fixed voltage lower than said anode voltage and a third terminal for supplying at least one of said plates with vertical deflection signal, are led out in parallel from said envelope.

23. A cathode ray tube according to claim 22, in which said first, second and third terminals are arranged horizontally in-line.

24. A cathode ray tube according to claim 23, in which said evacuated envelope comprises a transparent flat portion and a dish-shape portion which are sealed to each other.

25. A cathode ray tube according to claim 24, in which said terminals are placed between said flat portion and the sealing edge of said dish-shape portion.

* * * * *